US005303659A

United States Patent [19]

Berlin et al.

[11] Patent Number: 5,303,659

[45] Date of Patent: Apr. 19, 1994

[54] DOWN DRAFT WORK TABLE

[75] Inventors: Robert M. Berlin, Linwood; Richard L. Wendt; Warren L. Zeigler, both of Midland; Waynne R. Zeigler, Freeland, all of Mich.

[73] Assignee: Zeigler Enterprises, Midland, Mich.

[21] Appl. No.: 819,181

[22] Filed: Jan. 10, 1992

[51] Int. Cl.[5] ..... A47B 83/00; F23J 11/00

[52] U.S. Cl. ..... 108/50; 108/24; 454/49; 454/64

[58] Field of Search ..... 108/24, 50; 454/49, 454/64; 600/21; 5/606, 641, 423

[56] References Cited

U.S. PATENT DOCUMENTS

| | | | |
|---|---|---|---|
| 2,201,530 | 11/1935 | Tyler . | |
| 2,341,628 | 2/1944 | Koweindl | 108/50 |
| 2,945,731 | 7/1960 | Tutrone | 5/606 X |
| 3,442,230 | 5/1969 | Polen . | |
| 3,853,115 | 12/1974 | Jenn | 108/50 X |
| 4,063,495 | 12/1977 | Duvlis | 600/21 X |
| 4,218,963 | 8/1980 | Burnetter | 454/49 |
| 4,650,171 | 3/1987 | Howorth . | |
| 4,714,010 | 12/1987 | Smart | 454/64 |
| 5,244,433 | 9/1993 | Utterback | 454/49 |

FOREIGN PATENT DOCUMENTS 1579226 11/1980 United Kingdom .

OTHER PUBLICATIONS

Jewett Refrig. Brochure p. 684, no date.

*Primary Examiner*—Michael Milano

*Attorney, Agent, or Firm*—Robert L. McKellar

[57] ABSTRACT

A down draft work table useful in removing obnoxious fumes and gases. The work table comprises a support structure which contains a flat top mounted on an open-topped V-bottomed down draft chamber. The down draft chamber is attached such that one end of the V-bottom is lower than the opposite end of the V-bottom. The down draft chamber is assisted in the removal of gases by a series of air ducts and an air flow package. At least two work tables can be connected together in tandem through the air flow package.

3 Claims, 2 Drawing Sheets

DOWN DRAFT WORK TABLE

FIELD OF THE INVENTION

The invention disclosed herein deals with a down draft work table which provides the user with benefits not found in prior art tables.

This invention is also directed to a method for gathering and disposing of unwanted fumes, gases, odors, fine particulate materials, and liquids while utilizing a low volume of exhaust air.

This invention further deals with a method of controlling the flow of air over the work surface evenly such that heavier than air gases and the like can be efficiently removed from the work table surface, said method including the stacking or banking of two or more such tables end to end to enhance the control of the air through the system.

BACKGROUND OF THE INVENTION

Work tables of all sizes and descriptions have been made for a long time. The prior art is extensive and is directed to the various specific uses of such tables.

The tables are such that they have the capability of removing noxious odors, fumes, and liquids, and the like, but none of the tables represented by the prior art do all of these tasks in combination and moreover, none of the tables of the prior art do these tasks efficiently and economically.

Such prior art tables are represented by, for example the deluxe pedestal autopsy table manufactured by the Jewett Refrigerator Company and described and illustrated in a specification sheet having the form number PP684 showing model DPEM. This table has as its design features height control, integral sink, downward air exhaust, perforated body supports, i.e. table tops, center drain with basket strainer, perforated standpipe overflow and the like. The table is designed with a flat top surface and a convex bottom surface such that the fluids, et cetera drain to the center of the table for removal.

Tyler, in U.S. Pat. No. 2,201,530, issued Nov. 19, 1935, shows a vegetable table having a perforated top surface, which is actually a large mesh screen, to allow any vegetables laid thereupon to drain. The bottom of the table has a convex configuration with a moderately angled drop analogous to the autopsy table mentioned above. The Tyler table does not have an exhaust system, however, some modicum of air is allowed to flow over the vegetables by the action of water pumps which pump a continuous flow of water to cause a mist, which moves the surrounding air.

Polen, in U.S. Pat. No. 3,442,230, issued May 6, 1969, deals with a work table which is a laboratory table having internal ventilating means to remove vapors or gases from the uppermost surfaces of the working area of the table. This table allegedly provides for the removal of heavier than air gases. It should be noted that this table has a flat bottom surface, and the top surface is solid, with the flow of air being conducted over the outside edges of the top of the table. No perforated surface is shown or disclosed.

Howorth, in U.S. Pat No. 4,650,171, deals with an autopsy table which has a solid top surface and controls the flow of air downward by the use of various sized drawers at the back of the table. The top surface is slanted towards one end to facilitate the removal of liquids, as it can be observed from the Howorth Figures, especially FIG. 1, the top surface of the table at its lowest end is in communication with the sink and not with the exhaust system under the table.

British patent 1,579,226, published Nov. 12, 1980, deals with an autopsy table in which the top surface is convex in shape with a moderate angling towards the center of the surface, whereupon all fumes and liquids can be drained into a duct which then allows exhaustion of them to a collection point.

Thus, it can be observed that none of the prior art devices suggest or anticipate the instant invention with all of its benefits.

THE INVENTION

The invention disclosed herein deals with a down draft work table which provides the user with benefits not found in prior art tables.

The work table of the instant invention is a means for gathering and disposing of unwanted fumes, gases, odors, and liquids, and a means to evenly control the flow of exhaust air through the work surface so as not to produce eddy currents, or produce dead air spots or pockets which inhibit proper evacuation of the work surface resulting in unsafe work conditions in a laboratory environment. In addition, the ability to produce even air flow over the surface of the table allows the operator to achieve reproducible results in his or her lab experiments.

Further, the unique design of the invention work table allows one to conserve both expensive heated and cooled room air and thus the use of the table is economical.

The inventive tables of this invention can be stacked or banked while using the same exhaust source, all the while creating even air flow over the work surfaces. In addition, the unique design of this work table allows the banked or stacked tables to be worked independently of each other whereby, one, or more than one table, can be shut down without affecting the performance of any of the other tables in the stack or bank.

Thus, these significant advantages and others are provided by the unique table disclosed herein, a method of using the tables, and a method of evenly controlling the air across the upper surface of the table.

With specificity, this invention comprises in part, a work table comprising a support structure including side members fastened together in an end to end relationship to form an open rectangular frame, said frame having a top, a bottom, and an outside bottom edge. The table may have supporting legs depending downwardly from each corner of the rectangular frame or the table may be suspended and supported by adjacent cabinets or base units. The table has a flat top detachedly fixed to the interior of the rectangular frame below the top of the frame, such that the top covers all of the opening provided by the rectangular frame. The indicated top has a multiplicity of holes or perforations through it to allow for the flow of air and the like, yet the top also performs a support function for any item set upon it.

The table is fitted with an open top V-bottomed downdraft chamber attached by its upper edges to the outside bottom edge of the rectangular frame such that the V-bottom itself is the lowest point of the downdraft chamber. In order to be most effective in the removal of heavier than air gases and liquids, the downdraft chamber is attached such that one end of the V-bottom is lower than the other end of the V-bottom, typically this is the end which is closest to the main air exhaust. Located at the lowest end of the V-bottom chamber is a drain port for residual liquids and solids that may not be removable by the system. The downdraft chamber has a main air duct situated adjacent to and parallel with the longitudinal axis of the downdraft chamber, wherein the main air duct is connected to the V-bottom downdraft chamber by branch air ducts, there being at least two such branch ducts per main air duct. The branch air ducts are surmounted near their ends opening to the downdraft chamber by a controlled gate for controlling the flow of gases, including air, through them.

Also, more specifically, with regard to the method for gathering and disposing of gases, the method comprises the gathering and disposing of gases, particulate solids, and liquids utilizing the work table as described above, in conjunction with an air flow package, and further, with specificity, this invention deals with a method of gathering and disposing of gases, particulate solids, and liquids, wherein the method comprises utilizing more than one work table as described above in conjunction with an air flow package, and connection the work tables in tandem through an air flow package.

DETAILED DESCRIPTION OF THE INVENTION

Figure 1:
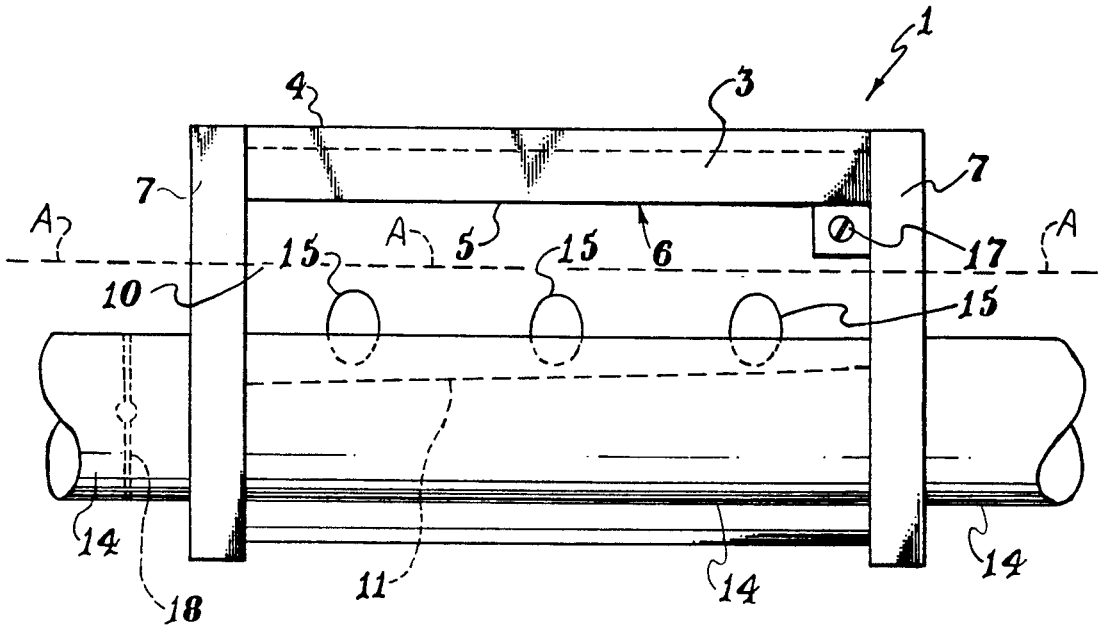
FIG. 1 is a front elevated view of a table of this invention.
Figure 2:
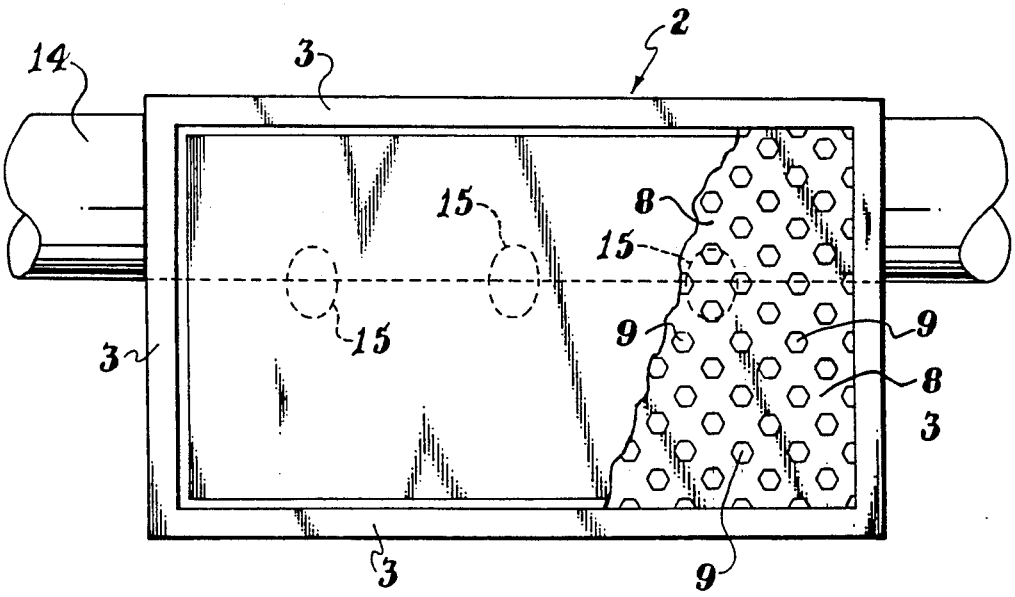
FIG. 2 is a top elevated view of a table of this invention.

With regard to the Figures, there is shown in FIG. 2 a top view of the table 1 of this invention comprising a support structure 2 including four side members 3 securely fastened together in an end to end relationship to form an open rectangular frame. The frame has a top 4 (see FIG. 1) and a bottom 5 (see FIG. 1) and an outside bottom edge 6. The support structure 2 may have legs 7 depending downwardly from each corner of the rectangular frame or may be supported without legs as will be shown infra.

The table 1 has a flat top 8 (only partially shown in FIG. 2). The flat top 8 is situated in the interior of the rectangular frame and slightly below the top of the rectangular frame such that the upper surface of the top 8 is below the upper surface of the rectangular frame. The top 8 is detachedly fixed to the interior of the frame such that it can be removed easily and cleaned periodically. The top 8 is large enough to cover essentially all of the opening provided by the rectangular frame so as to enhance air flow through any perforations therethrough. The top 8 has a multiplicity of holes or perforations 9 therethrough to accomodate the flow of air yet allow for support of any object set thereupon.

A V-bottomed downdraft chamber 10, (see FIG. 3) which has no top is fixedly attached to the bottom outside edge of the side members 3 and is positioned such that the V-bottom 11 (shown in phantom in FIG. 1) is tilted towards one of the ends 12 (see FIG. 3) of the downdraft chamber 10 and the V of the V-bottom is the lowest point of the downdraft chamber 10.

Figure 3:
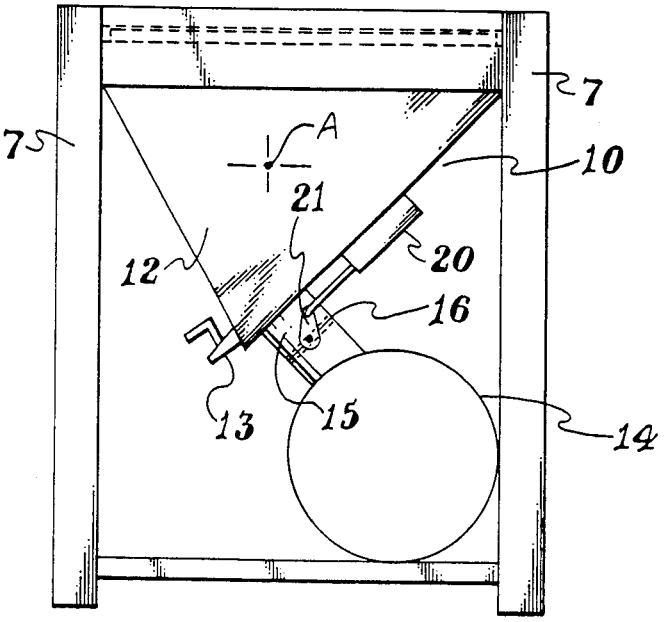
FIG. 3 is an end elevated view of a table of this invention.
Figure 4:
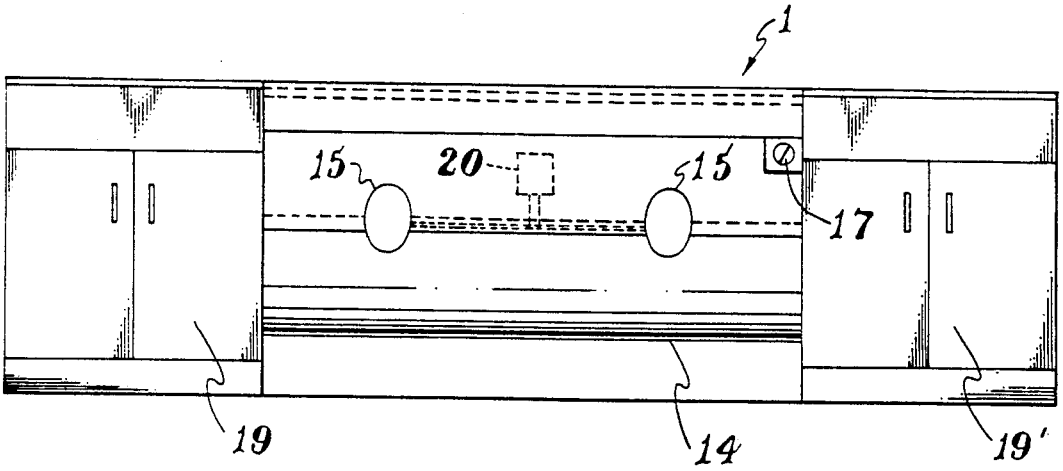
FIG. 4 is another embodiment of this invention which is a support for the table wherein there is shown a table 1 supported between two base cabinet units 19 and 19'.

As can be observed from FIG. 3, there can be a drain 13 located in the bottom of the V-bottom downdraft chamber 10 for draining any residual liquids or solids that may accumulate.

Returning to FIG. 1, it can be observed that there is a main air duct 14 located such that it is adjacent to and parallel with the longitudinal axis of the downdraft chamber 10. The main air duct 14 is connected to the V-bottom downdraft chamber 10 by branch air ducts 15, there being at least two, and preferably three or more, such branch ducts 15 per main air duct 14, per each table 1.

Each such branch ducts 15 contains therein a control gate 16 for controlling the flow of gases therethrough.

With reference to FIG. 1, there is also shown a selector switch 17 which can be selected to open or close the branch air ducts 15.

In operation, there is a standard air exhaust unit attached to one end of the main air duct 14 and the other end is capped. The standard air exhaust unit is not shown, but for purposes of describing this invention, the unit shall be attached to the left end of the main air duct 14 as it is shown in FIG. 1.

This invention is designed to use a standard air flow package, that is, air flow and exhaust can be provided by apparatus and methods known to those in the art and in general, utilization of the correct size motors and and controls to provide exhaust air for this invention is well within the knowledge of those skilled in the art and details of such apparatii and methods will not be detailed herein.

The desired air flow through the unit is calculated and the branch air ducts 15 are adjusted to a pre-determined open position in a manner that allows for a somewhat restricted air flow which graduates to less restricted the further away they are positioned in relationship to the exhaust source. The branch air ducts 15 can be manually operated at each individual table but all of the control gates 16 in the branch air ducts 15 may also be pneumatically driven by a pneumatic driver (motor) 20 linked to the gate 16 by a mechanical linkage 21 and the branch air ducts 15 are progressively linked to the other branch air ducts 15 on the same table so that they operate in tandem. The selector switch 17 is located on the table face and affords two positions, open or closed. The open positions are pre-arranged to allow for an even distribution of exhaust end to end for each table that is being used. The closed position allows a means to shut down individual tables, allowing exhaust air to flow through the main air duct 14 and exit the unit. When the tables 1 are stacked or banked, it is this main air duct 14 which is the connection between the tables, which are connected to each other by sleeves (not shown) which essentially prevent the leaking of air at the connected seams.

The invention also makes use of a motorized master damper gate 18 in the main air duct 14, which is linked (not shown) to the branch air ducts 15 mechanically or electrically or by way of a static pressure sensing device located in the interior of the main air duct 14. By whichever means, the master damper gate 18 monitors the total amount of exhaust required at any time for the number of tables being used, adjusting to the lowest volume of exhaust required to keep the room Variable Air Volume (HVAC system) under the lowest possible demand creating a more comfortable room environment and at a lower cost than normal.

This inventive table utilizes means to collect liquids, however the collection and discharging of liquids is really only incidental to the uniqueness of the invention, because the inventive table has the means to remove both liquids and fine, solid particulate materials by the movement of air and thus, there is very little of these materials to fall into the apex of the V-bottom to be eventually removed.

It is believed by the inventors herein, and they are not to be held to such a theory, that the inventive table deals with at least three different physical principals, in combination and simultaneously to enhance and facilitate the removal of particulate solids, gases, fumes, vapors and the odors which often accompany them. The three physical principals involved are gravity, kinetic energy and differential velocity.

Thus, the V-shaped bottom is designed to force heavier than air fumes to fall into the very bottom of the apex and move into the branch air ducts 15, without residing in the apex of the V or any other areas of the table. This aspect of the invention is not found in any of the prior art known to the inventors herein.

The V-bottom is slightly sloped along its longitudinal axis A—A towards the exhaust end of the main air duct 14 to assist and enable the collection and directing of gases to fall toward the branch air ducts 15, putting such gases closer to the higher air flow of the main air exhaust duct 14.

Heavier than air gases are difficult to set in motion and the movement of air for this purpose without some other supporting mechanism is generally not sufficient or efficient enough to move such materials unless there are tremendous velocities involved. In this invention, once the gases fall and are set in motion by gravity pulling them downward to the V-bottom, they are more easily transported by conventional air exhaust means, assisted by their own inertia without the need for very high velocity air.

Heavier than air gases act more like solid matter than do lighter than air gases. Thus, when gravity pulls these gases to the apex and down into the branch air ducts 15, these gases are readily captured by the relative higher velocity air in the branch air ducts 15. This relative higher velocity is differential to the lower velocity flowing in the main air duct 14. This allows for a much better evacuation at a much lower volume of air.

Conventional fume hoods draw air from the back of the hood and do very little to pull heavier than air fumes out of the lab area. Typically these fumes billow out of the hood onto the floor and into non-hood surrounding areas.

Thus the invention provides a means to increase usable laboratory space by providing a flat top surface to work on while providing a hood means for removing unwanted materials and thereby creating no need for a separate hood to remove such materials. Further, a means is provided to control laboratory room temperature and air pressure without requiring enormous amounts of expensive conditioned air to be exhausted. Finally, a means is provided to control the flow of air across the surface such that the flow is even all of the time resulting in consistant results in research activity.

We claim:

1. A work table comprising:

a support structure including side members fastened together in an end to end relationship to form an open rectangular frame, said frame having a top, a bottom, an interior and an outside bottom edge;

a flat top detachedly fixed to the interior of the rectangular frame below the top of the frame, said top covering all of the opening provided by the rectangular frame, said top having a multiplicity of holes therethrough;

an open top V-bottomed downdraft chamber having upper edges and opposite ends, said chamber being attached by its upper edges to the outside bottom edge of the rectangular frame such that the V-bottom is the lowest point of the downdraft chamber;

said downdraft chamber being attached such that one end of the V-bottom is lower than the opposite end of the V-bottom;

said downdraft chamber having a main air duct situated adjacent to and parallel with a longitudinal axis of the downdraft chamber, said main air duct being connected to the V-bottom downdraft chamber by branch air ducts, there being at least two such branch ducts per main air duct;

said branch air ducts being surmounted near their ends opening to the downdraft chamber by a controlled gate for controlling the flow of gases therethrough.

2. A work table as claimed in claim 1 wherein there is also present an air flow package.

3. A system for gathering and disposing of gases, fumes, particulate solids, and liquids, said system comprising an air flow package, and at least two work tables connected together in tandem through the air flow package, each said work table comprising a support structure including side members fastened together in an end to end relationship to form an open rectangular frame, said frame having a top, a bottom, an interior and an outside bottom edge;

a flat top detachedly fixed to the interior of the rectangular frame below the top of the frame, said top covering all of the opening provided by the rectangular frame, said top having a multiplicity of holes therethrough;

an open top V-bottomed downdraft chamber having upper edges, said chamber being attached by its upper edges and opposite ends to the outside bottom edge of the rectangular frame such that the V-bottom is the lowest point of the downdraft chamber;

said downdraft chamber being attached such that one end of the V-bottom is lower than the opposite end of the V-bottom;

said downdraft chamber having a main air duct situated adjacent to and parallel with a longitudinal axis of the downdraft chamber, said main air duct being connected to the V-bottom downdraft chamber by branch air ducts, there being at least two such branch ducts per main air duct;

said branch air ducts being surmounted near their ends opening to the downdraft chamber by a controlled gate for controlling the flow of gases therethrough.

* * * * *